United States Patent [19]

Nibert

[11] 4,062,785

[45] Dec. 13, 1977

[54] FOOD-COMPATIBLE LUBRICANT

[75] Inventor: Roger Keith Nibert, Hoffman Estates, Ill.

[73] Assignee: Borg-Warner Corporation, Chicago, Ill.

[21] Appl. No.: 660,558

[22] Filed: Feb. 23, 1976

[51] Int. Cl.[2] ..... C01M 1/10

[52] U.S. Cl. ..... 252/49.6; 252/51.5 A; 426/531; 426/609; 426/811

[58] Field of Search ..... 252/49.6, 51.5 A; 426/531, 609, 811

[56] References Cited

U.S. PATENT DOCUMENTS

| | | | |
|---|---|---|---|
| 1,870,074 | 8/1932 | Sullivan et al. | 252/51.5 A |
| 2,018,758 | 10/1935 | Ellis | 252/51.5 A |
| 2,031,930 | 2/1936 | Buc | 252/52 R |
| 2,291,396 | 7/1942 | Lieber | 252/51.5 A |
| 2,403,067 | 7/1946 | Fischer et al. | 252/51.5 A |

FOREIGN PATENT DOCUMENTS

| | | | |
|---|---|---|---|
| 983,040 | 2/1965 | United Kingdom | 252/51.5 A |
| 996,799 | 6/1965 | United Kingdom | 252/51.5 A |

OTHER PUBLICATIONS

Dreher, et al., "A Special Grease for the Food Industry," NLGI Spokesman, July 1966, p. 126–131.

Dooley, "Lubricants in the Food Industries," NLGI Spokesman, Apr. 1967, pp. 18–23.

Chem. Abstracts, Anon, 1966, p. 14857b "Food Additives, Mineral Oil."

*Primary Examiner*—Delbert E. Gantz
*Assistant Examiner*—Andrew H. Metz
*Attorney, Agent, or Firm*—Joseph Shekleton

[57] ABSTRACT

A non-aqueous lubricant which is adapted for use with food-handling machinery. It comprises white mineral oil as the principal constituent and a minor proportion of a fatty amide.

8 Claims, No Drawings

FOOD-COMPATIBLE LUBRICANT

This invention relates to a lubricant composition. More particularly, it relates to a lubricant composition which, because of its non-toxic nature, is adaptable for use with machinery wherein food materials are processed or transported.

The large-scale processing of foods has given rise to a problem not previously known when food was handled in small lots. The reason for this is the fact that food now is processed almost exclusively by machinery. Fruit is picked mechanically, potatoes are dug mechanically, crops like corn and wheat are harvested mechanically, all finished food products are packaged mechanically, and the transport of foods is handled by conveyors or other mechanical devices. All processing of foods involves the use of mechanical equipment at one or more stages of such processing.

With the increasing concern for the purity and safety of foods it has become more and more important to insure the cleanliness of all equipment with which these foods come in contact. As a part of this concern attention has been directed to the lubricant compositions used to lubricate this equipment, because it is difficult to prevent leakage or breakdown of the equipment which in turn permits contamination of the food by the lubricant composition.

The operation of a large municipal water system, for example, requires the transport of huge quantities of water. This is accomplished by large pumps, the lubrication of which requires a considerable quantity of lubricant composition. If the pump housing or heat exchanger which contains the lubricant composition develops a leak, or if the pump malfunctions so as to discharge the lubricant, then a serious problem of contamination (of the public drinking water) is presented.

Many such disturbing possibilities are readily perceivable and it is manifestly important that these possibilities be anticipated and prevented if at all possible.

One obvious method of preventing such contamination is to provide a sump area in which to collect any lubricant which leaks, splashes or spills from the pump or other mechanical device. Another method would provide means for cooling the pump or mechanical device other than by a water-cooled heat exchanger. Such mechanical solutions to the problem, however, require additional space, which frequently is at a premium.

The invention disclosed herein affords a more direct solution; it provides a lubricant composition which is non-toxic and therefore non-contaminating with respect to food and water. As such it is said to be of "food-grade" quality. The lubricant comprises a major proportion of white oil and a minor proportion of a fatty amide. Neither of these components is toxic so that the lubricant is compatible with the human diet, and the fatty amide possesses the necessary quality of lubricity which is imparted in sufficient quantity to the white oil to render the lubricant satisfactory for the lubrication of industrial devices.

The white oil is a substantially colorless, odorless, tasteless mineral oil.

Preferably, the fatty amide is a carboxamide. Sulfonamides are also contemplated but they are not so readily available as carboxamides, and their lubricity qualitites are not so apparent as with the carboxamides. Still more preferable are those fatty carboxamides having 12–18 carbon atoms and, especially, oleamide because it is readily available.

The effectiveness of the fatty amide is in direct proportion to its dissolved concentration. Unfortunately, its solubility in white oil is somewhat limited, and ordinarily it is advisable to use it at its maximum concentration, which is about 1.0 percent. Concentrations as low as 0.01 percent are useful, however, and concentrations within the range of from about 0.01 to about 1.0 percent are accordingly contemplated.

The lubricant composition herein may also desirably contain a fatty triglyceride such as lard oil or olive oil. The triglyceride, while not as effective a lubricity additive as the fatty amide, nevertheless supplies additional lubricity to the combination of white oil and fatty amide. Furthermore, it enhances the solubility of the fatty amide. The solubility of oleamide, for example, is increased by about 50% by the presence of 1–2% of lard oil. Effective concentrations of the fatty triglyceride range up to about 10 percent. In most instances the concentration will lie within the range of from about 0.5 to about five percent.

Where the lubricant is intended to be used continuously over a long period of time, especially at high temperature, it is advisable to incorporate an antioxidant into the composition. It may be any of the several well-known types of antioxidants which are effective to stabilize hydrocarbons. Specific illustrative species include butylated hydroxytoluene (BHT), butylated hydroxyanisole (BHA), betaphenylnaphthyl amine (BPNA), alpha-phenylnaphthyl amine, bisphenol A and nonyl phenol. Alkyl phenols are preferred, especially those having from about four to about 12 aliphatic carbon atoms.

The concentration of such antioxidants should be within the range of from about 0.1 to about 1.0%, preferably from about 0.2 to about 0.8%.

Also contemplated are such lubricants which contain minor proportions of anti-foam additives. In certain situations it is important that the lubricants herein be free of foam and in those situations the presence of a very small proportion of an anti-foam additive is indicated. Especially suitable for this purpose are the dialkyl silicone polymers represented by the structural formula:

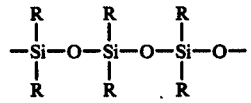

where R is lower alkyl, i.e., from one to four. Dimethyl silicone is preferred because of its ready availability and its particular effectiveness. Its concentration in the lubricant should be within the range of from about 0.0001 percent (1 ppm) to about 0.1 percent (1000 ppm).

Frequently the viscosity of the lubricant is of importance in a particular application, especially where the lubricant is to be used outdoors in varying temperatures. In such instance the lubricant should contain a viscosity index improving agent. A suitable viscosity index improving agent is a polyisobutylene having an average molecular weight of 35,000–140,000. The amount of viscosity index improving agent thus used should be within the range of from about 0.5% to about 15.0%, based on the lubricant composition.

The lubricants herein may be greases, as well as free-flowing compositions. Typical grease compositions include the following:

| | | | |
|---|---|---|---|
| 92.1% | White Oil | 91.3% | White Oil |
| 2 % | Lard Oil | 1.8% | Lard Oil |
| 0.5% | Oleamide | 0.4% | Oleamide |
| 0.4% | BHT | 0.5% | BPNA |
| 5 % | Bentonite | 5 % | Al Stearate |

A satisfactory food-grade lubricant must, first of all, be a good lubricant. That is, it must provide long-lasting lubricity over a wide range of temperature. It must protect relatively moving metal surfaces from the ravages of friction. Secondly, it must be compatible with food and water, in the sense that it can be ingested, at least in small quantities, by humans without adverse physiological effects. Third, it must not corrode the parts of the engine or mechanical device with which it comes in contact.

One of the many important applications of the lubricants herein is the lubrication of clutch surfaces. In this application it is important, not only that the frictional resistance of the clutch surfaces at or near zero sliding speed be somewhat diminished, but also that the ratio of static friction to dynamic friction be either about 1.0 or less than 1.0. Such ratio reflects a situation wherein the clutch surfaces can engage and disengage one another relatively smoothly, i.e., without noisy chattering and vibration. Thus it is important that the static friction be reduced while the dynamic friction remains the same or, at least, is reduced less than is the static friction.

This aspect of a lubricant's performance is tested in the Low Velocity Friction Test which is carried out in a bench apparatus. An upper steel plate, one inch in diameter, is rotated against a similar sized plate, with an attached 1/16 inch wide annulus of Raybestos 3672-3*, while immersed in the test lubricant. Friction between the rubbing surfaces is measured by means of a torque arm-strain gauge arrangement, attached to the lower plate. The torque signal is fed to the Y axis of an X-Y plotter and the speed signal from a tachometer-generator is fed to the X axis. External friction is minimized by supporting the lower plate assembly by an air bearing. The normal force loading the rubbing surfaces (of the above plates) is regulated by air pressure from below on the lower plate.

*A clutch surface composition containing about 54% cellulose, 19% talc and serpentine asbestos, 5% $Fe_2O_3$ and 22% phenolic resin.

The "static" coefficient of friction is measured while the upper steel plate is rotated against the lower stationary plate under a load of 50 psi at a speed of 0.02 feet per minute, and at temperatures of 90° F, 200° F and 300° F. The "dynamic" coefficient of friction is determined similarly at a speed of 130 feet per minute, i.e., a variable speed drive system is engaged to rotate the upper steel plate at a speed ranging upward from zero to 130 feet per minute.

Lubricants having the following additives, in the indicated proportions, are subjected to the above test:

| | Oleamide | Lard Oil | BHT |
|---|---|---|---|
| A. | None | None | None |
| B. | 0.1% | None | None |
| C. | None | 5% | None |
| D. | 0.1% | 2% | None |
| E. | 0.1% | None | 0.6% |
| F. | 0.1% | 2% | 0.6% |

In each instance the test lubricant consists of a mineral lubricating oil plus the additives indicated.

The test results are as follows:

TABLE I

| | Static Friction | | | Dynamic Friction | | | Ratio: S.F./D.F.* | | |
|---|---|---|---|---|---|---|---|---|---|
| | 90° F | 200° F | 300° F | 90° F | 200° F | 300° F | 90° F | 200° F | 300° F |
| A. | .196 | .266 | .280 | .201 | .149 | .165 | .975 | 1.785 | 1.697 |
| B. | .094 | .138 | .154 | .210 | .133 | .138 | .448 | 1.038 | 1.112 |
| C. | .100 | .122 | .145 | .183 | .102 | .095 | .546 | 1.196 | 1.526 |
| D. | .106 | .109 | .142 | .201 | .132 | .117 | .527 | .826 | 1.214 |
| E. | .094 | .144 | .162 | .182 | .124 | .140 | .516 | 1.161 | 1.157 |
| F. | .087 | .116 | .108 | .173 | .121 | .108 | .503 | .959 | 1.000 |

*S.F. is static friction; D.F. is dynamic friction.

Further testing of each lubricant after 6 hours at 300° F yields the following data:

TABLE II

| | Static Friction | Dynamic Friction | Ratio: S.F./D.F. |
|---|---|---|---|
| A. | .165 | .180 | .917 |
| B. | .208 | .166 | 1.253 |
| C. | .135 | .097 | 1.392 |
| D. | .142 | .135 | 1.052 |
| E. | .181 | .156 | 1.160 |
| F. | .135 | .120 | 1.125 |

It will be noted (in Table I) that the lubricants of the invention (B, D, E and F) perform better than those lubricants which contain no fatty amide (A and C), with respect to the ratio of static friction to dynamic friction. At 300° F lubricants A and C are both unsatisfactory in this respect, and even at 200° F lubricant A is unsatisfactory.

The data in Table II shows the stability of lubricants D, E and F upon prolonged exposure to relatively high temperature.

The lubricants herein are non-corrosive to copper. This is an important property because of the extensive use of copper bearings, copper heat exchangers, and the like in the type of machinery for which food-grade lubricants are intended. Such non-corrosivity is shown by means of a corrosion test wherein half-sectioned tubes of 90/10 Cupronickel and Admiralty Brass are suspended from a glass hook and immersed in 275 ml. of test lubricant at 200° F for 168 hours. Where the test lubricant is lubricant F above, the weight loss of the test specimens is nil and 0.0006 g. (of 15.0403 g.), respectively. The test lubricant in each case has a total acid number of 0.27 and a copper content less than 1 ppm; also, infrared analyses show a 10% and 15% reduction in carbonyl (ester) content, respectively.

I claim:

1. A food-grade lubricant comprising a major proportion of white mineral oil and a minor proportion, sufficient to enhance the lubricity of said lubricant, of a fatty carboxamide having the formula $RCONH_2$ where R has 11–17 carbon atoms.

2. A food-grade lubricant comprising a major proportion of white mineral oil and minor proportions, sufficient to enhance the lubricity of said lubricant, of each of a fatty carboxamide having the formula $RCONH_2$ where R has 11–17 carbon atoms and a fatty triglyceride.

3. The food-grade lubricant of claim 1 wherein the fatty triglyceride is lard oil.

4. The food-grade lubricant of claim 2 wherein the lubricant contains also from about 0.1 to about 1.0% of an alkyl phenol.

5. The food-grade lubricant of claim 4 wherein the alkyl phenol contains from about 4 to about 12 aliphatic carbon atoms.

6. The food-grade lubricant of claim 4 wherein the alkyl phenol contains at least two alkyl groups.

7. A food-grade lubricant comprising a major proportion of white mineral oil, minor proportions, sufficient to enhance the lubricity of said lubricant, of each of a fatty carboxamide having the formula $RCONH_2$ where R has 11–17 carbon atoms and lard oil, from about 0.1 to about 1.0% of an alkyl phenol and a foam inhibiting amount of polydimethylsilicone.

8. The food-grade lubricant of claim 7 wherein it contains also a viscosity index improving amount of a polyisobutylene viscosity index improving agent.

* * * * *